US005524977A

United States Patent [19]

Orawski

[11] Patent Number: 5,524,977

[45] Date of Patent: Jun. 11, 1996

[54] SECURITY DISPLAY CASE

[76] Inventor: Walter Orawski, 2 Orchard Heights Blvd., Apt. 209, Aurora, Ontario, Canada, L4G 3W3

[21] Appl. No.: 393,499

[22] Filed: Feb. 24, 1995

[51] Int. Cl.[6] ..... A47F 3/12

[52] U.S. Cl. ..... 312/114; 312/140; 312/257.1; 312/138.1; 312/265.5; 312/265.6

[58] Field of Search ..... 312/114, 140, 312/257.1, 265.5, 265.6

[56] References Cited

U.S. PATENT DOCUMENTS

| | | | |
|---|---|---|---|
| 1,846,485 | 2/1932 | Hart | 312/114 |
| 2,884,296 | 4/1959 | Meilinger et al. | 312/140 X |
| 3,150,903 | 9/1964 | Chapman et al. | 312/138 |
| 3,779,177 | 12/1973 | Gigante | 312/257.1 X |
| 3,879,096 | 4/1975 | Blodee | 312/257.1 X |
| 4,274,688 | 6/1981 | Zacky | 312/140 X |
| 4,281,883 | 8/1981 | Zacky | 312/140 |
| 4,566,742 | 1/1986 | Schmeid | 312/257.1 |
| 4,678,359 | 7/1987 | Keen | 312/140 X |

FOREIGN PATENT DOCUMENTS

| | | | |
|---|---|---|---|
| 835257 | 2/1970 | Canada | 312/140 |
| 900550 | 5/1972 | Canada | 312/114 |
| 48629 | 4/1934 | Denmark | 312/140 |
| 1263234 | 5/1961 | France | 312/140 |
| 2598188 | 11/1987 | France | 312/140 |
| 2132153 | 1/1972 | Germany | 312/140 |
| 2230213 | 5/1973 | Germany | 312/114 |
| 2313342 | 9/1974 | Germany | 312/140 |
| 526698 | 6/1957 | Italy | 312/257.1 |
| 184096 | 6/1963 | Sweden | 312/257.1 |
| 2040672 | 9/1980 | United Kingdom | 312/140 |
| 2151462 | 7/1985 | United Kingdom | 312/140 |
| 8601698 | 3/1986 | WIPO | 312/257.1 |

*Primary Examiner*—Peter M. Cuomo
*Assistant Examiner*—Rodney B. White
*Attorney, Agent, or Firm*—Mark B. Eisen

[57] ABSTRACT

A security display case provides top and bottom frames, each comprising an inner frame nested within an outer frame. The inner frames are assembled around top and bottom panels, and side panels are provided along their top and bottom edges with components for the outer frame which are inserted laterally into channels formed in the inner frame. Once the door is mounted the ends of the inner frame channels are closed off, and the side panels cannot be removed. The resulting display case is secure yet has no vertical frame components, leaving an unobstructed view of the display compartment.

6 Claims, 4 Drawing Sheets

SECURITY DISPLAY CASE

FIELD OF INVENTION

This invention relates to display cases. In particular, this invention relates to a security display case having a simple construction and utilizing few components, while providing an attractive and secure storage compartment for the display of valuable items.

BACKGROUND OF THE INVENTION

Display cases are commonly used for the storage and display of valuable items, such as museum pieces, art, jewelry and so on. These types of items require a strong, secure display compartment, to protect the contents of the display case from theft and vandalism, but the display area should utilize as few framing elements as possible, so that the contents of the display case are not obscured.

Additionally, it is advantageous for the display case to be completely knock-down, to reduce shipping costs, but it should be easy to assemble on site. To keep manufacturing costs down the display case should use a minimal number of differently configured elements, so that many of the components of the display case are interchangeable. This also has the advantage of facilitating the replacement of any damaged or broken component, and reduces the number of spare pieces which must be stored for this purpose.

SUMMARY OF THE INVENTION

The invention achieves the advantages outlined above in a display case which utilizes few components, many of which are interchangeable, yet provides a strong, tamper resistant display compartment that is relatively unobscured. The display case of the invention is also readily disassembled for storage or transport, and is easily reassembled for use.

The invention accomplishes this by providing upper and lower frames, each formed from an inner frame, comprising an assembly of extruded components, nested within an outer frame, comprising an assembly of complimentary extruded components. The transparent panels surrounding the display compartment are engaged into glazing channels in the outer frame components, which are then slidably inserted into the inner frame components to assemble the display compartment. Thus, with the exception of outer frame components for the door, which require minor modification, the entire frame for the display case can be formed from two different configurations of extrusion cut to size and mitred.

The resulting display case is attractive and practical, there being no vertical frame components to obscure the view of the item or items within the case, easy to manufacture and assemble or disassemble, and yet provides sufficient protection for the contents of the display case to permit its use by museums, art galleries, jewellers and in others security applications.

The present invention thus provides a display case comprising top and bottom panels, each respectively secured to a top inner frame comprising inner frame components connected together at adjoining ends and a bottom inner frame comprising inner frame components connected together at adjoining ends, outer frame components each having a glazing channel for engagement along top and bottom edges of rectangular panels, and means for engaging the outer frame components to the inner frame components to form an outer frame surrounding each inner frame.

The present invention further provides a display case comprising top and bottom frames respectively surrounding top and bottom panels, each of the top and bottom frames comprising an outer frame engaged to an inner frame, the inner frame comprising inner frame components each having mitred ends and a glazing channel for engaging the panel, a connecting channel into which a connecting bracket is disposed for connecting adjoining inner frame components, and a pair of flanges orthogonal to an outer face of each inner frame component supporting a pair of opposed lips forming a channel along the outer face, the outer frame comprising outer frame components each having mitred ends and a glazing channel for engaging a side panel, a connecting channel into which a connecting bracket is disposed for connecting adjoining outer frame components, and a pair of flanges orthogonal to an inner face of each outer frame component supporting a pair of opposed lips which slidably engage into the channel, and a ledge projecting inwardly from an inner face of each inner frame component for supporting the floor panel.

The present invention further provides a method of assembling a display case comprising top and bottom panels, each respectively secured into a top inner frame comprising inner frame components and a bottom inner frame comprising inner frame components, outer frame components each having a glazing channel for engagement along top and bottom edges of rectangular side panels, and means for engaging the outer frame components to the inner frame components to form an outer frame surrounding each inner frame comprising a pair of opposed lips projecting from one of the outer frame components or the inner frame components slidably engagable into a channel formed in the other of the outer frame components or the inner frame components, including the steps of suspending the top frame aligned above the bottom frame, aligning the outer frame components of a first side panel with the top and bottom inner frame components on a first side of the top and bottom frames and sliding the first side panel into engagement with the top and bottom frames, aligning the outer frame components of a second side panel with the top and bottom inner frame components on a second side of the top and bottom frames adjacent to the first side and sliding the second side panel into engagement with the top and bottom frames, aligning the outer frame components of a third side panel with the top and bottom inner frame components on a third side of the top and bottom frames adjacent to the first or second sides and sliding the third side panel into engagement with the top and bottom frames, and affixing a door to a fourth side of the top and bottom frames.

BRIEF DESCRIPTION OF THE DRAWINGS

The drawings illustrate by way of example only a preferred embodiment of the invention.

DETAILED DESCRIPTION OF THE INVENTION

Figure 1:
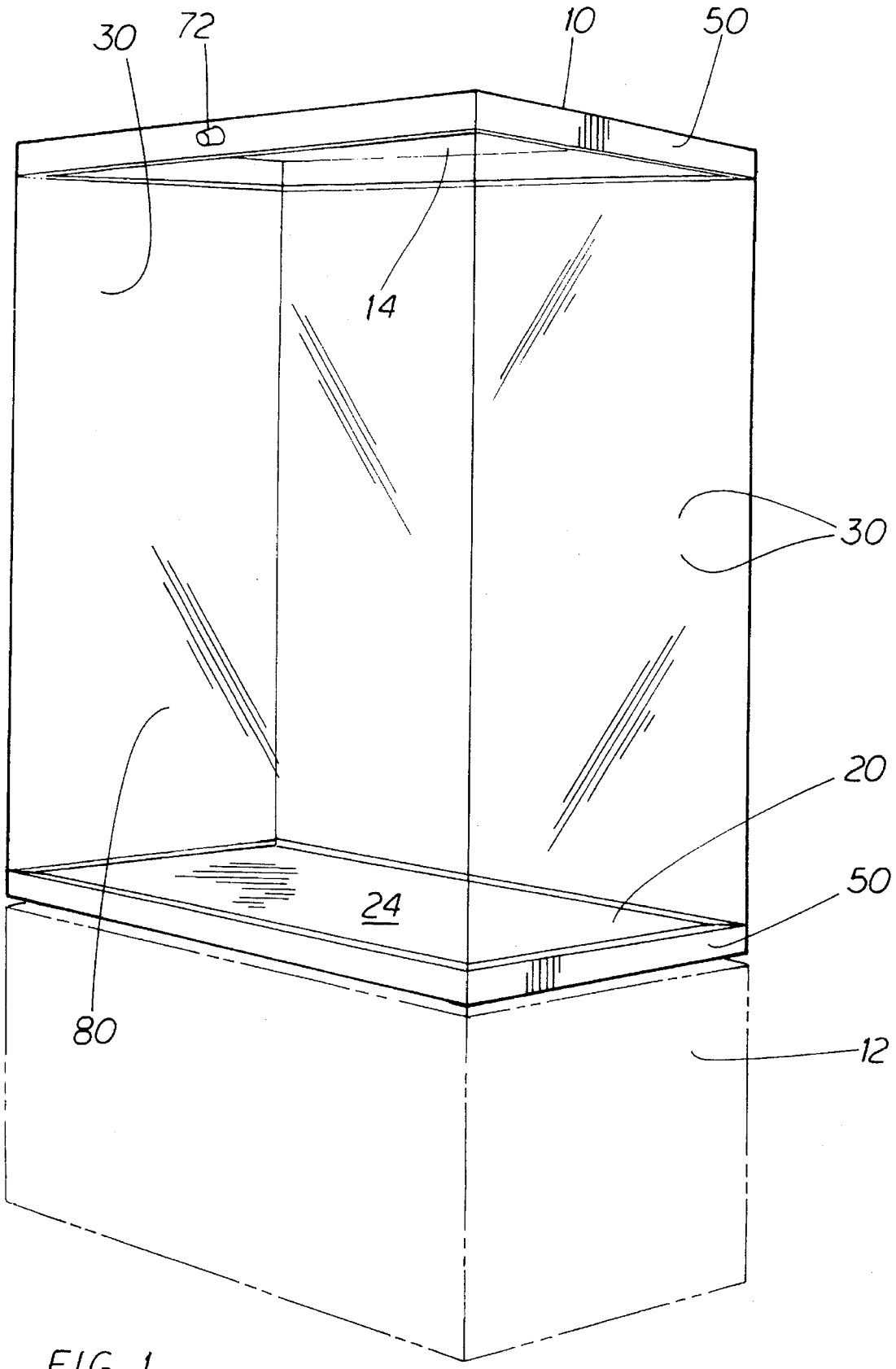
FIG. 1 is a perspective view of the display case of the invention, secured to a pedestal shown in phantom lines.

Referring to FIG. 1, in a preferred embodiment the display case comprises a rectangular top 10 and bottom 20, three transparent side panels 30 and a transparent door panel 80. An optional pedestal 12 is illustrated in phantom lines.

The side panels 30 may be composed of glass, or of acrylic or another transparent plastic, sufficiently thick to provide the desired degree of security. The side panels 30 are provided with squared top and bottom edges 32,34, so that the panels 30 seat properly in glazing channels 52 formed in the outer frame components 50, as described further below. The side edges of the panels 30, and the side edges of the door 80, may be squared or mitred, according to the desired appearance of the assembled display case.

Figure 2:
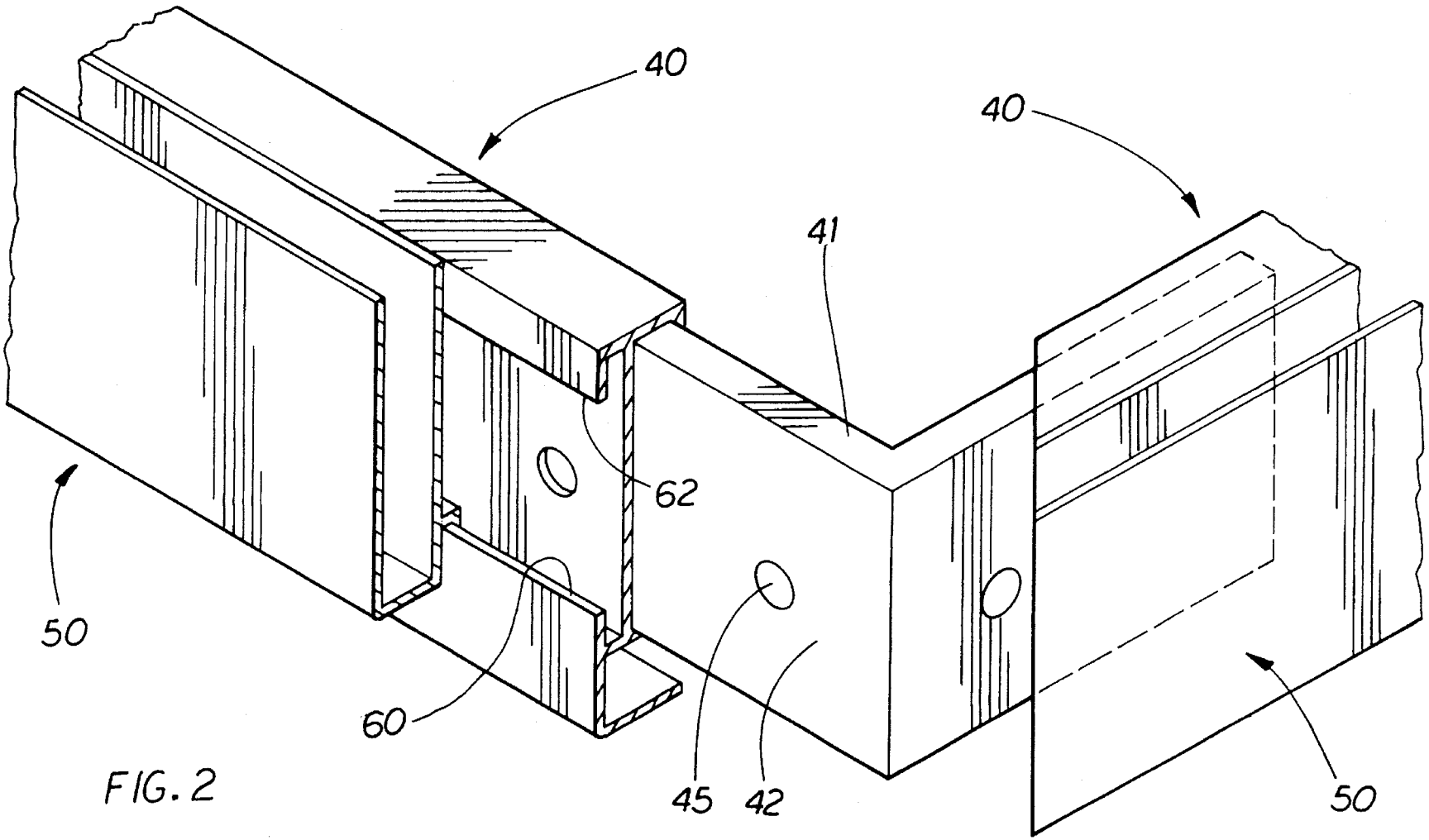
FIG. 2 is a perspective view of the frame components showing a preferred manner of connection between components of the inner frame.

The top 10 consists of an opaque or transparent panel 14 surrounded by framing members comprising inner frame components generally designated 40, which may be formed from aluminum, plastic or any other suitable framing material. The inner frame components 40 are preferably extruded and then cut to size, mitred at their adjoining ends as shown in FIG. 2, and connected together by "L"-shaped corner brackets 41, the arms of which are inserted into a connecting channel 42 in the inner frame components 40. The top panel 14 is seated in the glazing channels 44, and the corner brackets 41 are secured into the connecting channels by machine bolts or the like engaged in holes (not shown) drilled through the inner wall 46 of each inner frame component 40 and through tapped holes 45 in the arms of the corner bracket 41.

Figure 3:
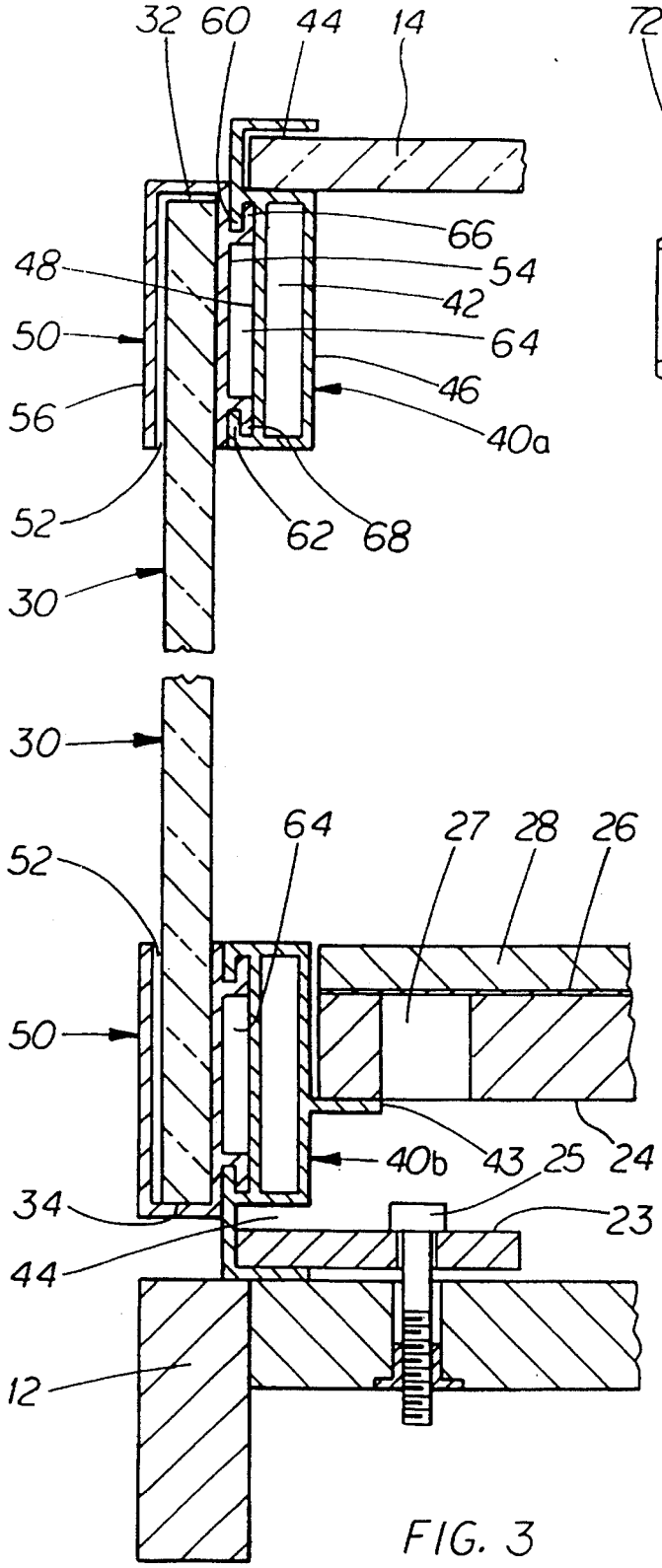
FIG. 3 is a cross section of the display case showing the configurations of the inner and outer frame components.

FIG. 3 illustrates inner frame components 40 of two slightly different configurations; top inner frame components 40*a* and bottom inner frame components 40*b*. It can be seen from FIG. 3 that bottom inner frame components 40*b* surrounding the bottom panel 24 are of substantially the same configuration as the top inner frame components 40*a* which surround the top panel, although in the case of the bottom 20 the components 40*b* of the inner frame are inverted. The only difference between the components 40*a* and the components 40*b* is a ledge 43 formed integrally with each component 40*b* and substantially orthogonal to the inner face of the inner frame components 40*b*, seen in FIGS. 3 and 4, which projects inwardly into the display compartment to support the bottom panel 24. Preferably the ledge 43 is spaced from the upper and lower edges of the frame component 40*b* so that in the finished display case the floor surface 26 of the bottom panel 24 is recessed from the top surface of the inner frame, leaving room for a decorative liner 28 to be placed on top of the floor 26. The bottom panel 24 is bolted or screwed from above the floor 26, through the liner 28 and bottom panel 26 into the ledge 43.

Figure 4:
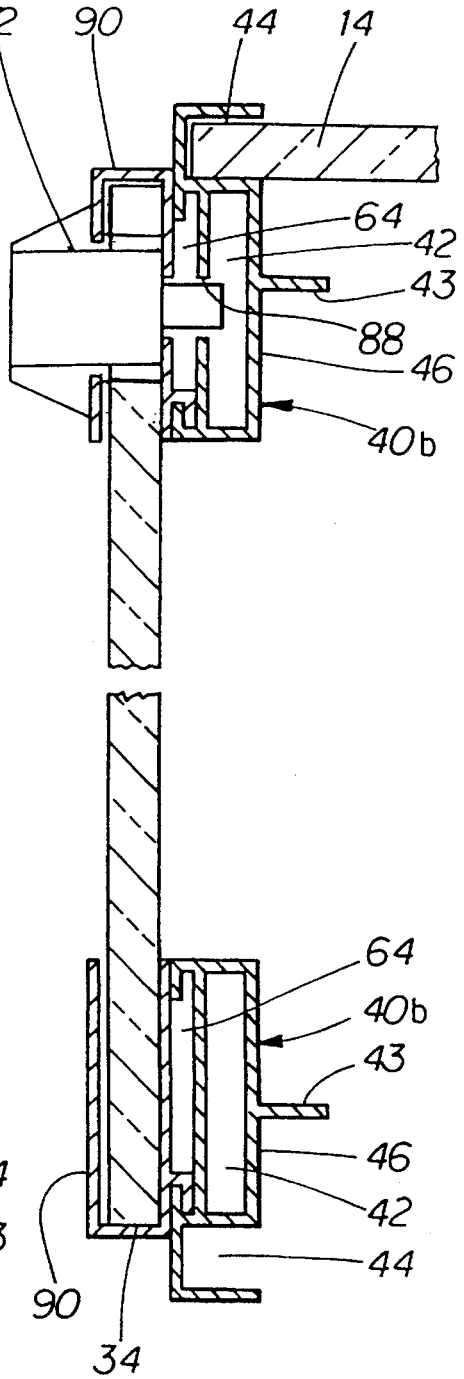
FIG. 4 is a cross section of a further embodiment showing the door seated in channels formed on the inner frames.

In order to reduce production costs, the same configuration of component 40*b* used for the bottom inner frame can be used to form the top inner frame, as shown in FIG. 4. However the ledge 43 is not needed to secure the top panel 12, which is seated in the glazing channels 44. A channel is formed between the ledge 43 and the top panel 14, hidden behind the top frame components 40*b* in the finished display case, which can be used to conceal wires for an electrical lighting fixture (not shown) inside the display compartment.

Alternatively, the top inner frame components 40*a* (without the ledge 43) can be used to form the bottom inner frame, in which case the bottom panel 24 may be secured to the inner frame components 40*a* using an elongated "L"-shaped bracket or a series of corner brackets (not shown) bolted, riveted or otherwise secured to the inner wall 46 of each component 40*a* in the bottom inner frame.

If the display case is to be seated on a pedestal 12, the glazing channel 44 in the components 40 of the bottom inner frame will accept a flat securing plate 23 bolted to the top of the pedestal 12, as shown in FIG. 3. In this embodiment a suitably sized hole 27 is drilled through the bottom panel 24, through which a screwdriver or socket wrench can be inserted to tighten the bolt 25 through the assembled bottom 20, or from inside the display compartment after the display case has been assembled, before the liner 28 is placed on the floor of the display compartment. The liner 28 will conceal the hole 27 in the assembled display case.

The outer face 48 of each inner frame component 40 is provided with a pair of opposed, inwardly facing flanges having lips 60,62 forming an engaging channel 64 into which the components 50 of the outer frame will be engaged, as described below.

The outer frame components 50 are preferably extruded from the same material as the components 40 of the inner frame. The outer frame components 50 each include a glazing channel 52, dimensioned to receive the edges of a side panel 30. The inner face 54 of the outer frame components 50 is provided with a pair of opposed, inwardly facing flanges having lips 66,68 which slidably engage into the engaging channel 64 formed by the lips 60, 62 of the inner frame components 40, as shown in FIG. 3. The same configuration of outer frame component 50 is used for both the upper and lower edges 32,34 of the side panels 30. Adjoining ends of the outer frame components 50 are cut slightly longer than those of the inner frame components 40 so that adjoining ends of the components of the outer frame 50 properly abut when mitred.

The components 50 of the outer frame may if desired be secured to the components 40 of the inner frame by bolts or other securing means extending through the inner frame components 40 and either bearing against the outer frame components 50 or extending into holes provided through the inner back 54 of the outer frame components 50. It may be preferable to engage the securing means through the corner brackets 41 as well, for extra reinforcement.

However, because of the construction of the display case, and in particular the manner in which the inner frame nests within the outer frame, it is unnecessary to secure the components 50 of the outer frame to the inner frame. This will become apparent as the assembly of the display case is described below.

The door 80 is provided with door frame components 90, identical in every respect to the outer frame components 50 except for the omission of the upper lip 66, as seen in FIG. 4. The lip 66 can be milled or ground off of a component 50, or a separate extrusion can be provided specifically for attachment to the upper and lower edges of the door 80. This enables the door to be set in place, with the lower lip 68 seated in the engaging channel 64. The lock 72 extends into a bore through the adjacent inner frame component 40 at the front of the top inner frame, which prevents the door 80 from being lifted; thus, the engagement of the lower lips 68 in the respective engaging channels 64 of the top and bottom inner frames 40 prevents removal of the door 80, until the lock is removed. The lock receiving hole 88 may be provided with a hardened steel ring (not shown) if desired for reinforcement.

To assemble the display case, outer frame components 50 are cut and attached along the upper and lower edges 32,34 of the the side panels 30. The door 80 is similarly provided with upper and lower outer frame components 90. An inner frame 40 is assembled around each of the top and bottom panels 14, 24 by securing corner brackets 41 into the securing channels 42. The bottom 20 may then be bolted to a pedestal 12 as described above, if desired.

Figure 5:
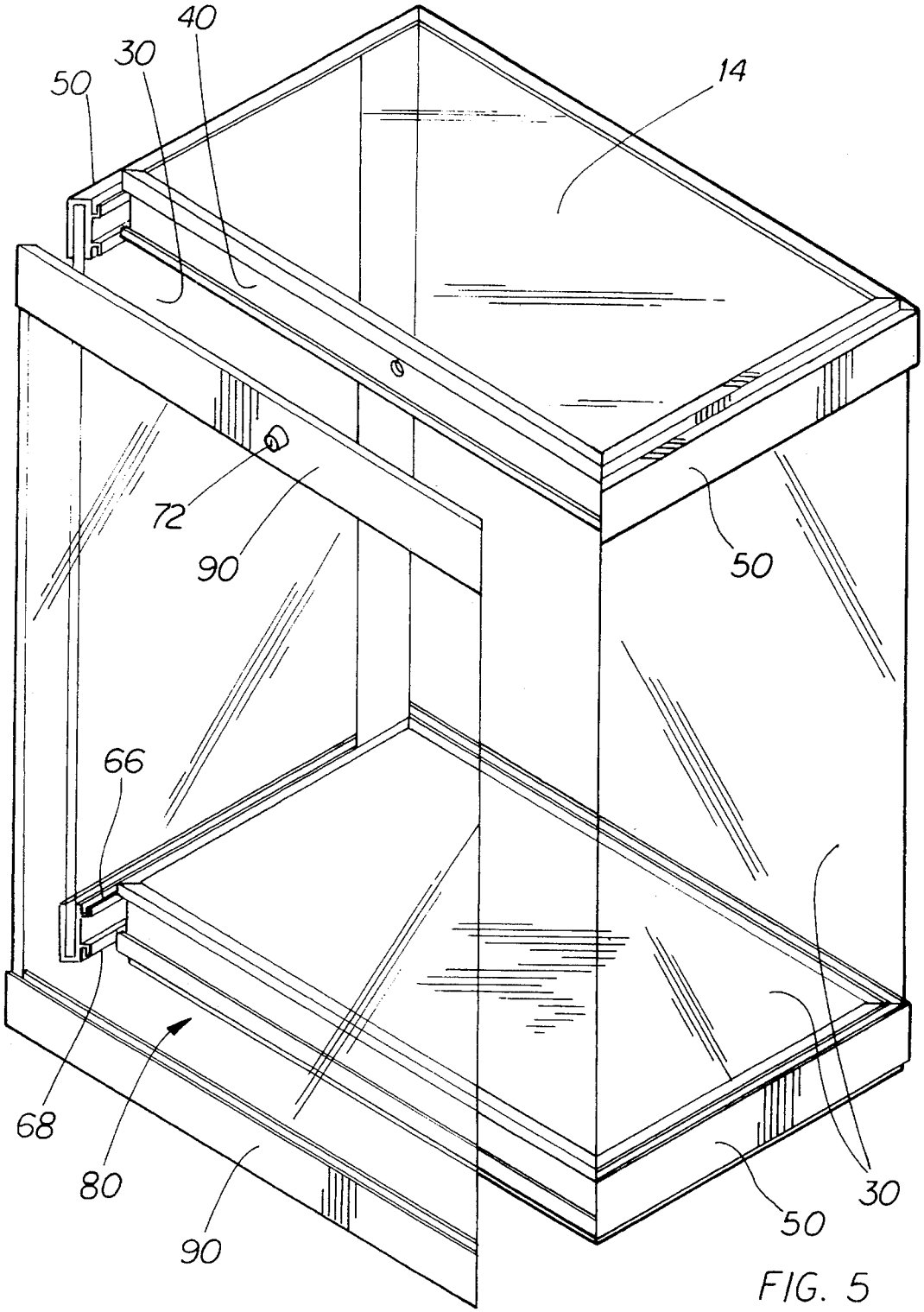
FIG. 5 is a partially exploded perspective view showing the manner of assembly of the display case.

The top 10 is suspended above and generally aligned with the bottom 20, and the side panels 30 are slid into place as shown in FIG. 5, the opposed lips 66,68 being inserted into the channel 64 through an open end of the frame component 40, in order either clockwise or counterclockwise around the display case. The ends of the outer frame members 50 of the first side panel 30 are aligned with the ends of the inner frame members 40 of the top and bottom frames, respectively, and the panel 30 is slid into position. The second and third side panels are likewise slid into position. Once the three side panels 30 are in place, the door 80 is mounted as described above.

It can thus be seen that, once the door 80 is in place, the three side panels 30 cannot be detached from the display case, because there is no longer an exposed end of any frame component 40 out of which the side panels 30 can be withdrawn. The outer frame is both assembled around and held in place by the inner frame.

Disassembly simply requires unlocking and removing the door 80, at which point the ends of the inner frame components 40 become exposed and the side panels 30 can then be removed by sliding them laterally, out of the engaging channels 64.

It can thus be seen that the display case of the invention provides an attractive and secure compartment for the display of valuable articles. The outer frame is securely fastened to the inner frame along the entire length of each frame component 40, 50, and there are no securing means visible along the outside faces 56 of the assembled frame. There are also no frame components along the vertical edges of the side panels 30 or the door 80 to obscure the view into the display case. Assembly and disassembly are simple procedures, and broken or damaged parts can be readily replaced from a relatively small inventory of parts.

The invention having been thus described with reference to a preferred embodiment, it will be apparent to those skilled in the art that certain modifications and adaptations may be made without departing from the scope of the invention, which is limited only by the appended claims. For example, it is immaterial whether the engaging channel 64 is formed on the components of the inner frame 40 or the components of the outer frame 50, or whether the lips 60,62 or 66,68 are orthogonal to the flanges from which they depend, so long as the structure provides engagement of the outer frame components 50 to the inner frame components 40 to form an inner frame supporting the top and bottom panels 14,24 nested within an outer frame supporting the side panels 30. This can be accomplished in a number of other ways well known to those skilled in the art.

I claim:

1. A display case comprising a top frame comprising inner and outer frame components and a bottom frame comprising inner and outer frame components, the components of the inner frames abutting and being detachably connected together at adjoining ends, the inner frame components each having a first channel for securing top and bottom panels, an outer face of the inner frame components opposite to the first channel and a first pair of engaging flanges each having a substantially orthogonal lip projecting from the outer face, the inner frame comonents each having mitred ends, top and bottom panels, each respectively secured within the first channels of the top and bottom frames, the outer frame components each having a second channel for engaging rectangular side panels, an inner face perpendicular to the second channel and a second pair of engaging flanges projecting from the inner face perpendicular to the second channel each having a substantially orthogonal lip for slidably engaging the first pair of engaging flanges, rectangular side panels secured within second channels of the outer frame components, and a door having a top edge and a bottom edge, a flange having a substantially orthogonal lip adjacent to the bottom edge for releasably engaging one engaging flange of the first pair of engaging flanges and locking means adjacent to the top edge, whereby the second pair of engaging flanges are slidably engaged to the first pair of engaging flanges to form an outer frame surrounding each inner frame.

2. The display case of claim 1 wherein abutting inner frame components are connected by a corner bracket.

3. The display case of claim 1 wherein the locking means comprises a lock attached to the door engaging an opening in the top inner frame.

4. The display case of claim 1 wherein the first pair of flanges is formed integrally with the inner frame components and the second pair of flanges is formed integrally with the outer frame components.

5. The display case of claim 1 wherein the first pair of flanges extends substantially between the ends of the inner frame components.

6. The display case of claim 1 wherein the second pair of flanges extends substantially between the ends of the outer frame components.

* * * * *